United States Patent [19]

Edgar

[11] 3,949,443

[45] Apr. 13, 1976

[54] COIN CONTROLLED GOLF BALL WASHER

[76] Inventor: John B. Edgar, 6119 Glenwood Drive, Baton Rouge, La. 70806

[22] Filed: Dec. 2, 1974

[21] Appl. No.: 528,931

[52] U.S. Cl. ..... 15/21 A; 15/3.12; 68/58; 134/145

[51] Int. Cl.[2] ..... A63B 47/04

[58] Field of Search ..... 15/3.12, 3.13, 3.14–3.16, 15/21 A, 3.2, 3.21; 134/145, 153, 157, 159; 68/58

[56] References Cited

UNITED STATES PATENTS

| | | | |
|---|---|---|---|
| 2,154,106 | 4/1939 | Nicosia | 15/3.16 |
| 2,584,070 | 1/1952 | Walker | 68/58 |
| 3,276,833 | 10/1966 | Felstehausen | 15/21 A |
| 3,352,131 | 11/1967 | Smith | 68/58 |
| 3,784,996 | 1/1974 | Ambrose | 15/21 A |
| 3,820,183 | 6/1974 | Gustafson | 15/21 A |

FOREIGN PATENTS OR APPLICATIONS

| | | | |
|---|---|---|---|
| 25,314 | 4/1963 | Germany | 15/3.12 |

*Primary Examiner*—Edward L. Roberts
*Attorney, Agent, or Firm*—Clarence A. O'Brien; Harvey B. Jacobson

[57] ABSTRACT

A coin controlled golf ball washer having a liquid-tight enclosure arranged for containing a bath of a cleaning solution, and a drum rotatably mounted in the enclosure immediately adjacent the bath and provided with an opening arranged for permitting placement of golf balls into and withdrawal of the balls from the drum. A coin controlled motor selectively rotates the drum for causing solution to be transferred from the bath into the drum by a carrier arrangement associated with the drum, and for tumbling the golf balls to be cleaned against scouring brushes arranged within the drum.

4 Claims, 4 Drawing Figures

COIN CONTROLLED GOLF BALL WASHER

BACKGROUND OF THE INVENTION

1. Field of the Invention

This invention relates generally to apparatus for washing golf balls, and the like, and particularly to an apparatus for automatically washing several golf balls simultaneously.

2. Description of the Prior Art

During playing of the game of golf, the balls used to play this popular game frequently become caked with dirt, mud, and the like, that affects the, for example, roll of the ball during putting, as well as retards the flight of the ball through the air. Accordingly, golfers frequently find it necessary and desirable to clean their golf balls. Various apparatuses have been proposed for washing or otherwise cleaning golf balls, but these known devices have been so troublesome to operate that they have not met with much commercial success. For example, some of these previous apparatuses have required the operator to manipulate a scoop manually in reverse to recover the golf balls from a washing solution. Other systems require special plumbing to provide water for jets and sewage to take off the resulting waste, while others are operated entirely by hand. Further, some of these known devices require the golf balls to be washed one at a time, while still others use a series of fiber brushes that soon deteriorate and have to be replaced.

Prior patents believed pertinent to the present invention are as follows:

U.S. Pat. Nos. 1,469,274 Oct. 2, 1923; 1,898,809 Dec. 6, 1932; 1,954,738 Apr. 10, 1934; 1,991,183 Feb. 12, 1935; 2,619,662 Dec. 2, 1952; 3,099,027 July 30, 1963; 3,119,134 Jan. 28, 1964; 3,125,775 Mar. 24, 1964; 3,784,996 Jan. 15, 1974.

SUMMARY OF THE INVENTION

It is an object of the present invention to provide a golf ball cleaning apparatus which is adapted to be used by the average golfer at a club house, and the like.

It is another object of the present invention to provide a golf ball cleaning apparatus wherein the operator simply loads a plurality of golf balls into the device and activates the machine by simply shutting the door providing access to the interior of the device and depositing a coin and the golf balls are automatically washed in a very short period of time without further effort being exerted by the operator, who merely removes his golf balls by opening the aforementioned door subsequent to cleaning of the golf balls.

It is yet another object of the present invention to provide a golf ball cleaning apparatus that may be installed permanently at a convenient location for the golf players, and which requires only a minimum of maintenance to be retained in operative conditions.

These and other objects are achieved according to the present invention by providing a golf ball washer having: a liquid-tight enclosure arranged for containing a bath of a cleaning solution; a drum provided with an opening arranged for permitting placement of golf balls into and withdrawal of cleaned balls from the drum, with the drum being rotatably mounted and arranged immediately adjacent the bath; a carrier arrangement associated with the drum for transferring solution from the bath to the drum during rotation of the drum; and an activator arrangement for selectively rotating the drum.

A preferred drum according to the present invention is in the form of a hollow cylinder having one open end, forming the opening in the drum, and one closed end, and a shaft journaled on the enclosure and affixed to the hollow cylinder for supporting same within the enclosure. Advantageously, the cylindrical wall of the drum will be arranged immediately adjacent a surface of the bath of cleaning solution in the enclosure.

The hollow cylinder is advantageously provided with at least one slot, and with a scoop arranged on an outer surface of the hollow cylinder and associated with the slot. In this manner, rotation of the hollow cylinder will cause the scoop to pick up solution from the cleaning bath and guide the solution thus picked up through the slot and into the interior of the cylinder. According to a preferred feature of the present invention, the entire interior surfaces of the hollow cylinder are covered with brush-forming bristles arranged for scrubbing the golf balls being washed by tumbling the golf balls against the bristles during rotation of the hollow cylinder.

Preferably, the actuator arrangement includes a motor operatively connected to the shaft rotatably supporting the drums selectively rotating the drum, and a coin controlled device connected to the motor for selectively energizing the motor upon reception in the coin controlled device of a predetermined coin.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENT

Figure 1:
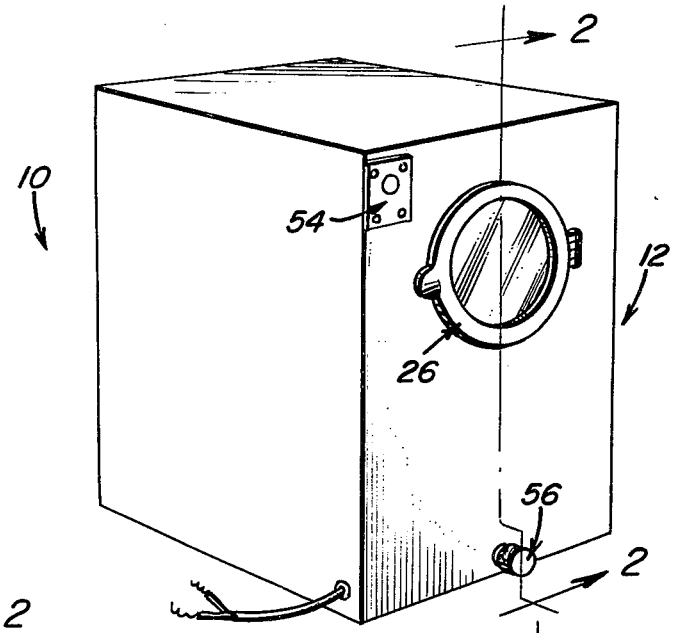
FIG. 1 is a perspective view showing a possible external appearance for a golf ball washer according to the present invention.
Figure 2:
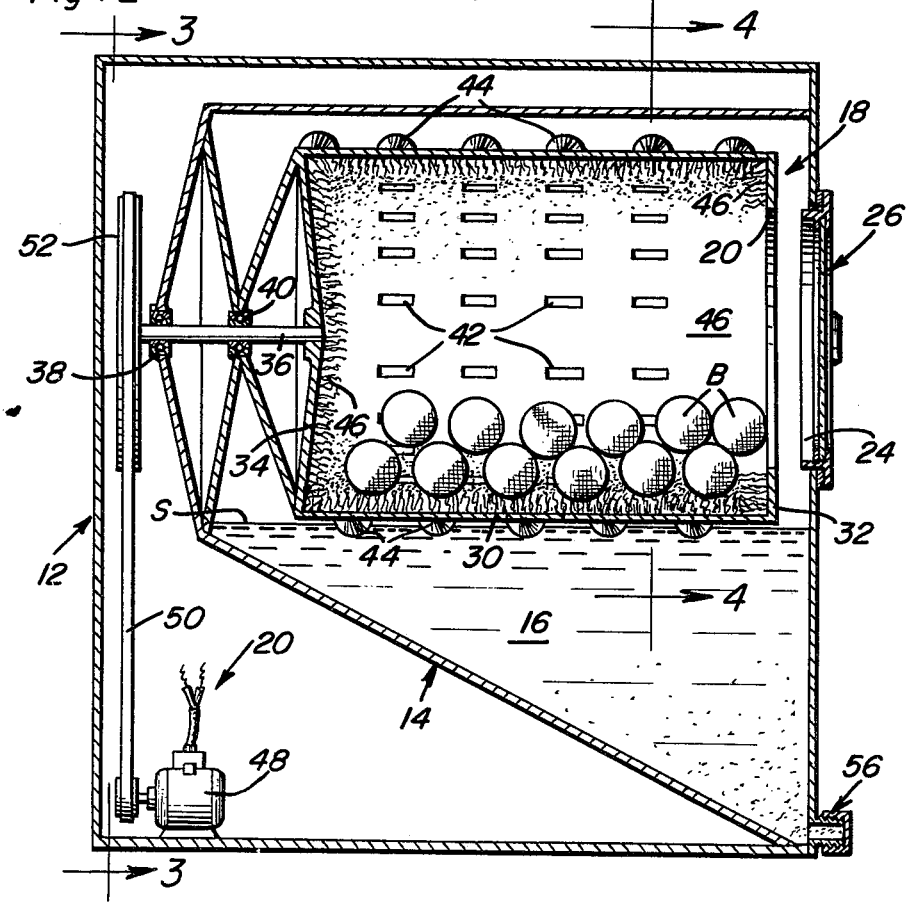
FIG. 2 is a sectional view taken generally along the line 2—2 of FIG. 1.
Figure 3:
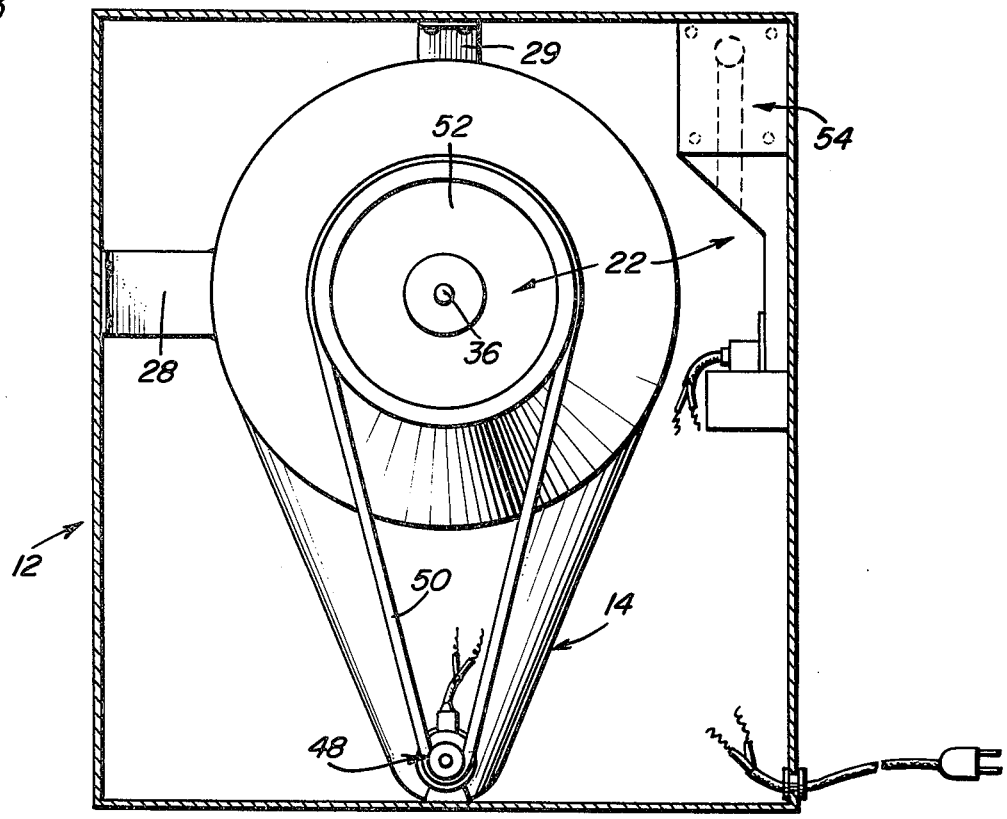
FIG. 3 is a sectional view taken generally along the line of FIG. 2.

Referring now more particularly to FIGS. 1–3 of the drawings, a golf ball washer 10 according to the present invention includes a housing 12 in which is mounted a liquid-tight enclosure 14 arranged for containing a bath 16 of a suitable cleaning solution. A drum 18 provided with an opening 20 arranged for permitting golf balls to be placed in and withdrawn from the drum is rotatably mounted within enclosure 14 immediately adjacent the surface S of bath 16. Drum 18 is provided with a carrier arrangement, to be described in greater detail below for transferring the solution from bath 16 to the interior of drum 18. An actuator arrangement 22, also to be described in detail below, is likewise disposed within housing 12 for selectively rotating drum 18. Housing 12 is advantageously provided with an access opening 24 with which is associated a door 26 hinged on housing 12 so as to selectively cover and uncover opening 24. Access opening 24 is preferably arranged opposite opening 20 provided in drum 18 for permitting selective access to the interior of the drum.

As can be seen from FIG. 3 of the drawings, enclosure 14 is removably mounted within housing 12 as by suitable mounting brackets 28 and 29 welded, for example, to enclosure 14 and bolted, and the like, to associated walls of the housing.

Drum 18 includes a hollow cylinder 80 having one open end 32, forming opening 20, and one closed end 34. A shaft 36 is journaled on enclosure 14 as by conventional bearings 38 and 40 and the special bracing structure seen in FIG. 2 of the drawings. In this manner, cylinder 30 is supported cantilever-fashion within enclosure 14 so that the cylindrical wall of cylinder 30 is immediately adjacent surface S of bath 16.

Figure 4:
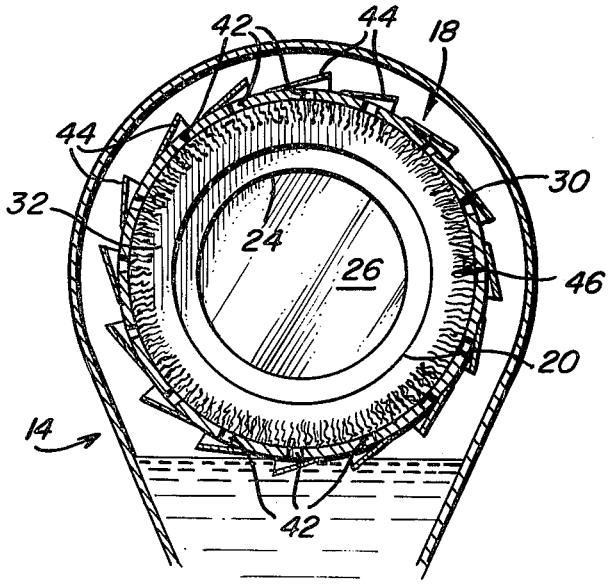
FIG. 4 is a fragmentary, sectional view taken generally along the line 4—4 of FIG. 2.

Referring now to FIGS. 2 and 4 of the drawings, cylinder 30 is provided in the cylindrical wall thereof with a plurality of slots 42. A plurality of scoops 44, which may have either the illustrated wedge-shape or an appropriate curve-shape, and the like, are arranged on an outer surface of the cylindral wall of cylinder 30 and are associated with slots 42. By this arrangement, it will be readily appreciated that scoop 44 will engage the solution in bath 16 as cylinder 30 is rotated and carries, or guides, the solution poured in through the slots 42 into the interior of cylinder 30. Thus, slots 42 and scoops 44 cooperate to form the carrier arrangement referred to above.

The interior surfaces of cylinder 30 are advantageously entirely covered with artificial bristles, and the like, which form brushes 46. These brushes 46 will, thus, scrub the golf balls B (FIG. 2) being washed in cylinder 30 by tumbling the golf balls against the brushes 46 during rotation of cylinder 30. Polyethylene has been found suitable for constructing the bristles which form brushes 46. These bristles may be mounted on a suitable backing (not shown) with both the brushes and the associated backing being provided with slots that match the slots in the cylindrical wall of cylinder 30.

The actuator arrangement 22 advantageously includes, for example, a suitable electrical motor 48 connected to shaft 36 as by a conventional belt 50 and pulley 52 affixed to shaft 36. In this manner, actuation of motor 48 as by a conventional coin-controlled arrangement 54 will cause shaft 36, and accordingly drum 18, to be rotated. Since coin-controlled devices suitable for use as in arrangement 54 are well known and conventionally employed, it is not considered necessary to describe such a suitable device in detail herein. Any suitable, known device that closes an electrical circuit upon detection of a suitable coin being placed in the device will suffice as arrangement 54.

A washer 10 requires very little effort by the operator (not shown). A golfer, and the like, need only deposit his golf balls into washer 10 by opening door 26 which may be provided with a conventional latch, depositing the golf balls in drum 18 by passing same through openings 24 and 20, closing door 26, inserting an appropriate and predetermined coin into arrangement 54, and removing the golf balls B out through openings 20 and 24 after the washer has completed its predetermined cycle. This cycle may be determined by, for example, a suitable timer (not shown) commonly employed with conventional coin-controlled devices. Outside of motor 48 that supplies the power to turn drum 18, washer 10 requires minimum maintenance since it has as parts subject to wear only two bearings, 38 and 40, which hold drum 18.

A manager, and the like, of a, for example, club house may have a washer 10 installed permanently at a convenient location for the golf players. Further, enclosure 14 may be filled with a, for example, soapy pumice cleaning solution, and the like, to which may be added only a cup of water, or so, directly through opening 24 once every so often to replace evaporation.

Washer 10 is easy to clean. Simply open drain 56 arranged at the bottom of housing 12 by removing the cap screw thereof, drain the solution from enclosure 14, replace the cap on drain 56, and replenish the solution in enclosure 14. This need only be done about, for example, once a year. A conventional garden hose (not shown), and the like, may be inserted through opening 24 in order to facilitate removal of excess sediment from the bath portion of enclosure 14.

A washer 10 may be installed permanently, or it may be made portable with only access to an electrical outlet being required.

As will be appreciated from the above description and from the drawings, with a washer 10 according to the present invention, the golf balls B are not immersed in a solution, but a liquid soapy pumice cleaning solution, and the like, is poured over the balls as they slide across, for example, polyethylene blades that scrub them as they slip and slide inside rotary drum 18. All golf balls B used in this country have a uniform size, shape, and weight, so it is a simple matter to provide a proper pulley ratio that will prevent the balls being carried a full 360 degrees, but will cause the balls to be carried only, for example, 45 degrees to 180 degrees inside rotating drum 18. Further, the balls slide across the plastic brushes as the drum turns.

Thus, a washer 10 is feasible for commercial marketing, and will provide a practically maintenance free device.

Advantageously, the level of surface S of bath 16 will remain below the external surface of cylinder 30 which forms drum 18 at all times, and will only be high enough in enclosure 14 for the cups or scoops 44 to dip the solution up as the drum 18 rotates. As soon as drum 18 ceases rotation, the solution will drain off of the balls B and blades or bristles of brushes 46 to a level beneath drum 18. Adjacent to each proportionately spaced scoop 44 is the aforementioned slot 42 which opens into the polyethylene, for example, covered interior surface of cylinder 30 and which allows for intake and drain of the cleaning solution. The slots 42, however, are dimensioned sufficiently small that a golf ball B will not fall through the slots and into the bath 16. Thus, an operator will not get his hands wet if he allows his golf balls to drain a few seconds after the washer has completed its wash cycle.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be resorted to, falling within the scope of the invention.

What is claimed as new is as follows:

1. A golf ball washer, comprising, in combination: a liquid-tight enclosure arranged for containing a bath of a cleaning solution; a drum provided with an opening arranged for permitting ball placement into and withdrawal from the drum, with the drum being rotatably mounted and arranged immediately adjacent the bath; carrier means for transferring solution from the bath to the drum; actuator means for rotating the drum, the drum including a hollow cylinder having one open end, forming the opening in the drum, and one closed end, and a shaft journaled on the enclosure and affixed to the hollow cylinder for supporting same, and the hollow cylinder is provided with a plurality of slots arranged evenly spaced around the cylinder in at least four rows, and with scoops arranged on an outer surface of the hollow cylinder and associated one with each slot, the hollow cylinder arranged relative to a surface of the bath for permitting the scoops to pick up solution from the bath as the cylinder rotates and to guide the solution through the slots and into the cylinder, the scoops and slots forming the carrier means.

2. A structure as defined in claim 1, wherein the interior surfaces of the hollow cylinder are covered with brush means for scrubbing golf balls being washed in the cylinder by tumbling the golf balls against the brush means during rotation of the hollow cylinder.

3. A structure as defined in claim 2, wherein the actuator means includes a motor operatively connected to the shaft rotatably supporting the drum for selectively rotating the drum, and a coin-controlled means connected to the motor for selectively energizing same.

4. A structure as defined in claim 3, further including a housing, the enclosure, drum, and actuator means arranged within the housing, and the housing provided with an access opening and a door arranged for selectively covering the access opening, the access opening arranged opposite the open end of the hollow cylinder for permitting selective access to the cylinder.

* * * * *